US006941770B1

(12) United States Patent
Taras et al.

(10) Patent No.: US 6,941,770 B1
(45) Date of Patent: Sep. 13, 2005

(54) HYBRID REHEAT SYSTEM WITH PERFORMANCE ENHANCEMENT

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/891,939

(22) Filed: Jul. 15, 2004

(51) Int. Cl.[7] ..... F25B 41/00
(52) U.S. Cl. ..... 62/512; 62/90; 62/173; 62/196.4
(58) Field of Search ..... 62/513, 498, 90, 62/238.6, 176.1, 176, 196.4

(56) References Cited

U.S. PATENT DOCUMENTS 3,264,840 A * 8/1966 Harnish ..... 62/173
5,651,258 A * 7/1997 Harris ..... 62/90
6,427,461 B1 * 8/2002 Whinery et al. ..... 62/176.6
6,701,723 B1 3/2004 Dobmeier

* cited by examiner

*Primary Examiner*—Melvin Jones
(74) *Attorney, Agent, or Firm*—Carlson, Gaskey & Olds

(57) ABSTRACT

An economizer loop is incorporated into the refrigerant system, which in conjunction with any selected reheat mode of operation, provides augmented performance, improved reliability, and enhanced control in meeting external heat load demands. A refrigerant system includes several features that can be selectively utilized alone or in combination with each other to provide an enhanced control over system cooling and dehumidification capability. In particular, a reheat coil is incorporated into the refrigerant system, and has alternative connection points to the main circuit, positioned both upstream and downstream of a condenser. Also, a flow control device allows a selective bypass around a condenser. In this manner, the refrigerant flowing through the reheat coil can be controlled to provide a desired level of temperature and humidity. Finally, the compressor may include an unloader feature such that additional steps in capacity control can be provided.

16 Claims, 2 Drawing Sheets

HYBRID REHEAT SYSTEM WITH PERFORMANCE ENHANCEMENT

BACKGROUND OF THE INVENTION

This application relates to a refrigerant system having a variety of operational features. In particular, a reheat coil is incorporated and can selectively receive a refrigerant flow from a location either upstream or downstream of a condenser to provide precise control over system operation characteristics. In further features, an economizer circuit is incorporated into the system, to selectively function in conjunction with the reheat coil, as well as the ability to bypass the condenser is provided.

This application relates to refrigerant systems that incorporate both an economizer cycle concept and a reheat coil to provide better dehumidification performance and temperature control in response to variable latent and sensible heat load demands.

Refrigerant systems are utilized to control the temperature and humidity of air in various environments. In a typical refrigerant cycle, a refrigerant is compressed in a compressor and delivered to a condenser. In the condenser, heat is exchanged between outside ambient air and the refrigerant. From the condenser, the refrigerant passes to an expansion device, at which the refrigerant is expanded to a lower pressure and temperature, and then to an evaporator. In the evaporator heat is exchanged between the refrigerant and the indoor air, to condition the indoor air. When the refrigerant system is operating in a cooling mode, the evaporator cools the air that is being supplied to the indoor environment.

In addition, as the temperature of the indoor air is lowered, moisture usually is also taken out of the air. In this manner, the humidity level of the indoor air can also be controlled.

In some cases, the temperature level, to which the air is brought to provide a comfort environment in a conditioned space, may need to be higher than the temperature that would provide the ideal humidity level. This has presented design challenges to refrigerant system designers. One way to address such challenges is to utilize reheat coils. In many cases, the reheat coils, placed in the way of indoor air stream behind the evaporator, are employed for the purpose of reheating at least a portion of the air supplied to the conditioned space after it has been overcooled in the evaporator, where the moisture has been removed.

On the other hand, enhancement of system efficiency is one of the foremost concerns in the HVAC&R industry. One of the options available to the refrigerant system designer to increase efficiency is a so-called economizer cycle. In the economizer cycle, a portion of the refrigerant flowing from the condenser is tapped and passed through an economizer expansion device and then to an economizer heat exchanger. This tapped refrigerant subcools a main refrigerant flow that also passes through the economizer heat exchanger. The tapped refrigerant leaves the economizer heat exchanger usually in a vapor state and is injected back into the compressor at an intermediate compression point. The subcooled main refrigerant is additionally subcooled after passing through the economizer heat exchanger. Then the main refrigerant flows through a main expansion device and to the evaporator. This main refrigerant flow will provide a higher capacity and/or efficiency, due to extra subcooling in the economizer heat exchanger. An economizer cycle thus provides enhanced system performance characteristics.

As mentioned above, another option available to a refrigerant system designer is to include a reheat coil into the system schematics. As known, at least a portion of the refrigerant upstream of the expansion device is passed through a reheat heat exchanger and then is returned back to the main circuit. At least a portion of a conditioned air, having passed over the evaporator, is then passed over this reheat heat exchanger to be reheated to a desired temperature.

Recently, the assignee of this invention obtained a patent disclosing the use of both a reheat coil and an economizer cycle in a refrigerant system. Still various schematics can provide enhanced control over such systems as well as flexibility in their design and operation.

SUMMARY OF THE INVENTION

In a disclosed embodiment a refrigerant system is provided with a reheat coil. A pair of 3-way valves selectively communicates a location either upstream or downstream of a condenser to the reheat coil.

In further features, an economizer cycle is incorporated into the system and can be selectively utilized in conjunction with the reheat coil. Further, the refrigerant system is provided with the ability to bypass the condenser when little or no temperature reduction is desired.

These and other features of the present invention are better disclosed in the attached drawings and specification. The following is a brief description of the drawings.

DETAILED DESCRIPTION OF THE PREFERRED EMBODIMENT

Figure 1A:
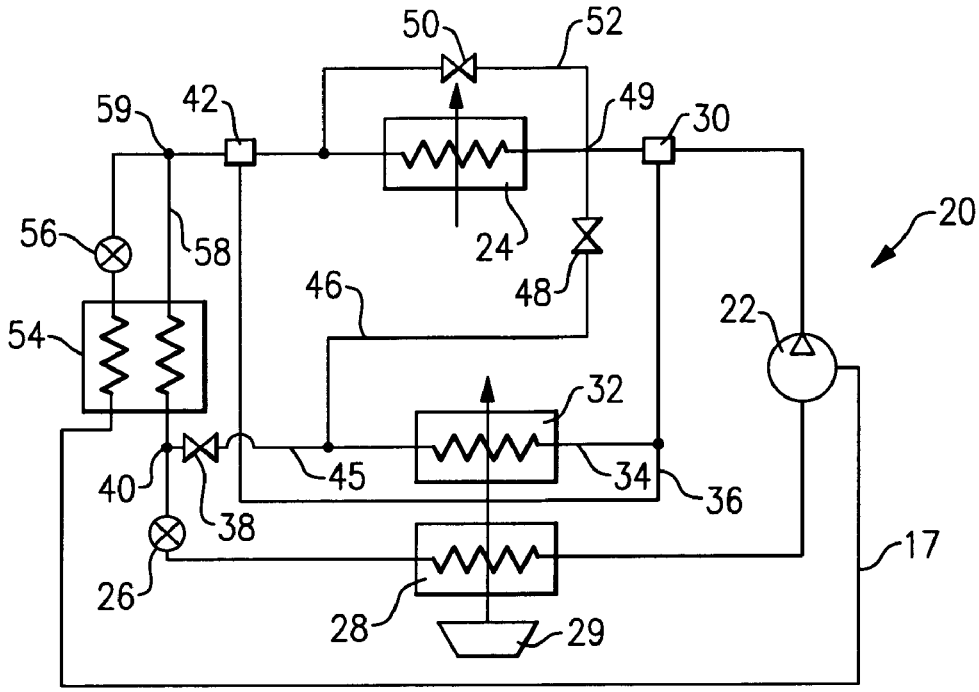
FIG. 1A shows a first schematic refrigerant cycle.

The refrigerant system 20 is illustrated in FIG. 1A. Refrigerant system 20 includes a compressor 22 delivering a compressed refrigerant into a discharge line. Downstream of the compressor 22 a condenser 24 receives the compressed refrigerant. As is known, a main expansion device 26 is positioned downstream of the condenser, and the refrigerant flows through the main expansion device to an evaporator 28. As is also known, an air moving device, such as a fan 29, blows air over the evaporator 28 and into an environment to be conditioned. The refrigerant returns to the compressor 22 from the evaporator 28.

The above is a brief description of the main features of known refrigerant cycles. The present invention offers greater control over the parameters of the conditioned air stream as well as enhanced flexibility in system operation and design than those provided in the prior art. In particular, a first three-way valve 30 selectively communicates refrigerant in the line downstream of the compressor either to a reheat coil 32 or towards the condenser 24. If refrigerant flows from the valve 30 toward the reheat coil 32, it will pass into a line 34 and through the reheat coil 32. A second supply line 36 will selectively deliver refrigerant to the reheat coil 32 when the three-way valve 42 is opened and the three-way valve 30 is closed. Now, a control for the refrigerant system 20 has the option of obtaining refrigerant for supply to the reheat coil 32 from a location either upstream of the condenser 24 (valve 30) or downstream of the condenser 24 (valve 42).

Refrigerant leaving the reheat coil 32 can either pass into line 45, or into line 46. The flow direction is dependent upon whether valves 48 or 38 are opened. If valve 38 is closed and valve 48 is open, the refrigerant will return to point 49. Assuming the valve 50 is then closed, the refrigerant will then pass through the condenser 24.

On the other hand, if valve 38 is opened but valve 48 closed, the refrigerant will return to the main refrigerant line at point 40. The purpose of this alternative control for the reheat coil 32 will be explained below. Obviously, the valves 38 and 48 have to operate in conjunction with the three-way valves 30 and 42 to make sure that the refrigerant is always returned to the main circuit to the point downstream of the refrigerant supply point to the reheat loop.

Further, an economizer heat exchanger 54 is incorporated into refrigerant system 20. A refrigerant is tapped from the main refrigerant line at point 59 and passes through an economizer expansion device 56. Downstream of the economizer expansion device 56 is the economizer heat exchanger 54. The main refrigerant in line 58 also passes through the economizer heat exchanger 54. While the refrigerant is shown flowing in the same direction from both the tap line and the main line 58, in practice, it would be preferable if the two refrigerant streams are moving in the counterflow relationship. However, for simplicity of illustration the two streams are shown flowing in the same direction. As is known, the economizer cycle lowers the temperature of the refrigerant in the main line by subcooling it in the economizer heat exchanger by the tapped refrigerant, which is expanded to lower pressure and temperature in the economizer expansion device 56. As is shown in this figure, the tapped refrigerant downstream of the economizer heat exchanger 54 is returned to the compressor 22 through a return line 17, preferably in the vapor state.

One further feature of the system 20 is a bypass line 52 for selectively bypassing the condenser 24. For instance, should the valve 48 be closed but the valve 50 open, some refrigerant will flow around the condenser 24. Obviously, various configurations involving condenser bypass can be arranged by opening and closing appropriate flow control devices, if desired. These options can be utilized, for example, when humidity control is required, but little or no temperature change is desired.

Figure 1B:
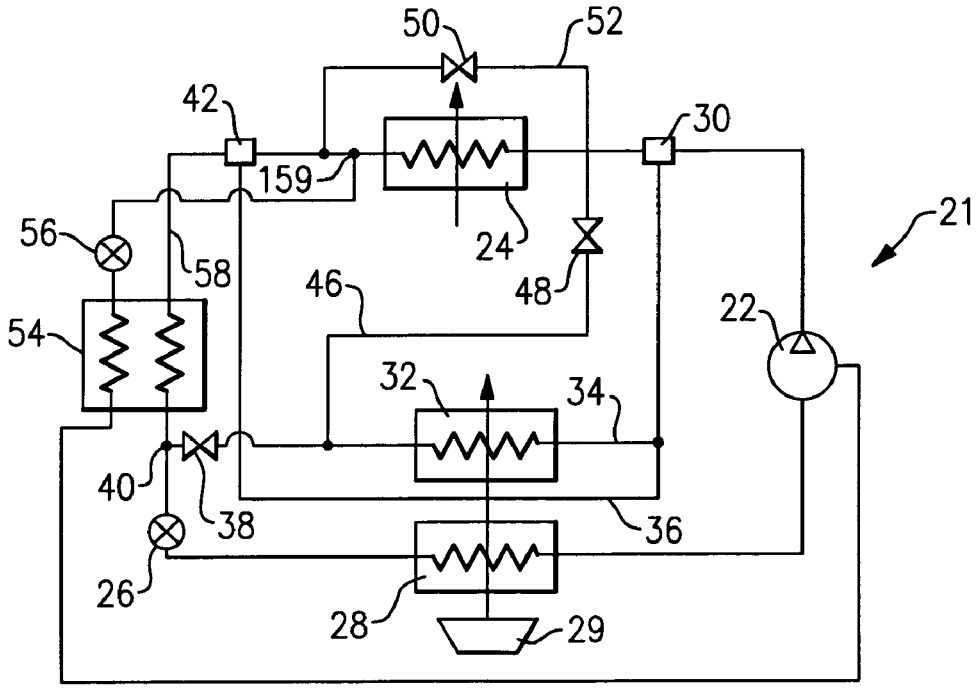
FIG. 1B shows a variation of the FIG. 1A embodiment.

FIG. 1B shows a slightly different embodiment from the FIG. 1A embodiment. In the FIG. 1B embodiment, the location of the tap 159 has been moved to be upstream of the three-way valve 42, and also upstream of the point where the bypass line 52 returns to the main refrigerant flow line. Otherwise, the FIG. 1B embodiment is similar to the FIG. 1A embodiment. It should be understood that the economizer tap can be located downstream of the economizer heat exchanger 54 as well. Other locations are also possible.

When conventional cooling is desired, without dedicated humidity control, then the valve 30 may be positioned to direct refrigerant toward the condenser 24, and not to the reheat coil 32. Similarly, the three-way valve 42 is positioned to direct the refrigerant from the condenser 24 downstream toward the main expansion device 26. Shut-off valves 38, 48 and 50 would all be maintained preferably closed. The refrigerant would thus pass through the system in a manner similar to conventional refrigerant cycles. The economizer circuit could be functional during this conventional cooling if the sensible cooling load demand is relatively high.

If cooling and dehumidification are desired, predominantly for hot and humid environments, then the three-way valve 30 is opened to direct the refrigerant towards the condenser 24. The three-way valve 42 is positioned to direct the refrigerant toward the reheat coil 32. Shut-off valve 38 is preferably opened, while shut-off valves 48 and 50 remain closed. Refrigerant will now pass from the three-way valve 42 through the line 36 to the reheat coil 32. The refrigerant will return to the main line through the open shut-off valve 38, at point 40. As is known, the warm liquid, which would be provided to the reheat coil 32, will be able to somewhat (not significantly) raise the temperature of the air being delivered over the evaporator 28. At the same time, the evaporator 28 will be operated at significantly lower temperatures (due to increased refrigerant subcooling in the reheat coil) to provide a sufficient amount of cooling and enhanced dehumidification. The selective operation of the economizer heat exchanger 54 in conjunction with the reheat coil 32 offers the benefits of further enhancing system dehumidification capability, when required, and at the same time allows for boost of the performance characteristics.

Under other conditions, dehumidified air with minimal temperature change can also be provided. To achieve this goal, the valve 30 is opened to direct the refrigerant to the reheat coil 32. The valve 42 is positioned to direct the refrigerant downstream toward the main expansion device 26. The valve 48 is opened and the valves 38 and 50 remain closed. Now, hot gas is directed to the reheat coil 32. When the air passes over the reheat coil 32, it will heat the air to a temperature greater than was provided in the first mentioned scenario. In this way, the air will not be cooled by any significant amount. Similarly to the scenarios discussed above, inclusion of the economizer loop and its selective operation offers significant benefits of superior system operation and control as well as in providing additional unloading steps to closely match latent heat load demands.

Under other conditions, it may be desirable to heat the air but still dehumidify the air. To achieve this goal, the valve 30 is positioned to direct the refrigerant toward the reheat coil, and the valve 42 is positioned to direct the refrigerant toward a main expansion device. The valve 38 is opened and the valve 48 is closed. With this scenario, a bleed circuit may need to be added to manage refrigerant charge migration. In this scenario, the reheat coil, acting as a condenser, would release more heat than the evaporator cooling capacity, providing a combined heating effect to the dehumidified (in the evaporator) air stream supplied to the conditioned space. Analogously, the economizer circuit, when operational, will enhance control over system dehumidification capability and reduce a number of start-stop cycles, improving system reliability.

Finally, in some humid environments, dehumidification may be desired with some variable temperature control. To achieve this, the valve 30 is opened to direct the refrigerant towards the condenser. The valve 42 is opened to direct the refrigerant towards the reheat coil. The valves 38 and 50 are opened, with the valve 48 maintained shut. Now, some of the refrigerant would pass through the bypass line 52, bypassing the condenser 24. Control over the amount of the bypass flow allows for variable system subcooling and consequently for variable sensible heat ratio, satisfying changing external sensible and latent load demands. The economizer circuit operates on demand in conjunction with the reheat loop to achieve similar advantages to the benefits outlined in the scenarios above.

It should be noted that the list of the configuration scenarios for the system 20 outlined above to achieve certain cooling and dehumidification performance is not exhaustive and a similar outcome can be obtained by rerouting the refrigerant through the cycle in a different manner. It is not an object of this invention to provide a complete list of such scenarios and the system capability, as described above, is provided for illustrative purpose only.

Figure 2A:
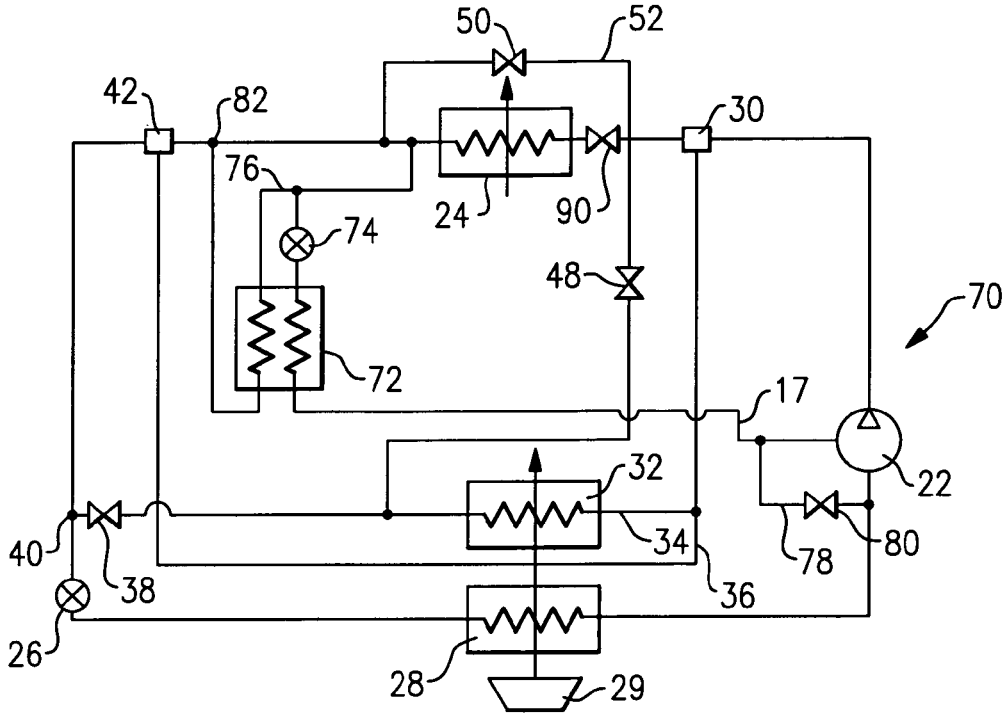
FIG. 2A shows a third schematic.
Figure 2B:
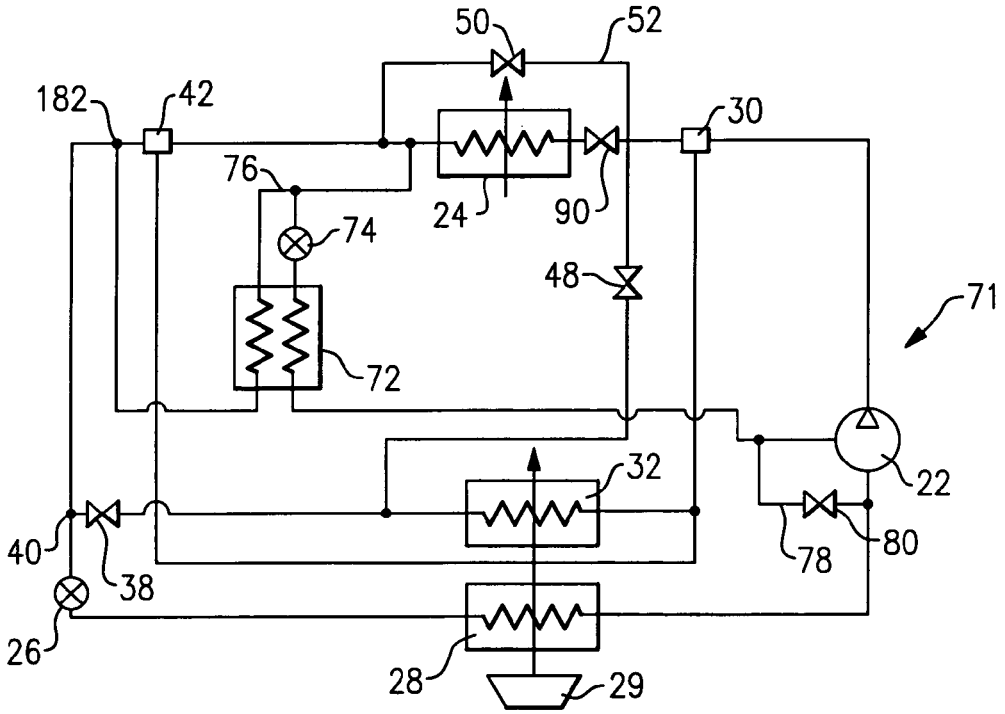
FIG. 2B shows a fourth schematic.

As shown in FIGS. 2A and 2B, a separate shutoff valve 90 may be incorporated into the system schematic to further ensure the complete bypass of refrigerant around the condenser 24. On the other hand, rather than complete bypass, some metering (through modulation or pulsation) of the refrigerant around the condenser can be performed by controlling valves 50 and 90. This metering would allow control of the temperature of the refrigerant downstream of the condenser 24, and an amount of sensible and latent cooling available in the evaporator 28. In this manner, the control for the refrigerant system can manage the actual sensible heat ratio, or in other words relationship between sensible and latent components of the system capacity, providing an additional degree of freedom in precisely matching an external heat load.

The economizer loop connections are arranged in FIGS. 2A and 2B in a slightly different manner, with the tap line located downstream of the condenser 24 but upstream of the bypass line 52 return point to the main circuit. Additionally, the return point of the economizer loop to the main circuit can be either upstream of the three-way valve 42 (point 82 in FIG. 2A) or downstream of the three-way valve 42 (point 182 in FIG. 2B).

Furthermore, the position of the economizer heat exchanger in relation to the reheat coil can have a number of different configurations, including various parallel and sequential arrangements. Additionally, the economizer heat exchanger can be included on any particular branch of the reheat loop. It is not an object of this invention to provide an exhaustive list of such design options and they are shown for illustrative purpose only.

As also shown in FIG. 2A an unloader line 78 selectively communicates intermediate compression chambers in the compressor 22 back through a valve 80 to a suction line. Typically, this unloading feature would be engaged when the valve 74 is preferably closed. In this manner, the line 78 selectively communicates the return line from the economizer back to suction. The general concept of selectively communicating intermediate compression chambers back to compressor suction through an unloader valve and preferably utilizing the same passages as injection ports for an economizer cycle is known.

By providing the unloader feature, a control for this system will be capable of providing additional distinct steps of cooling capacity. Thus, even greater control is provided.

In general, a worker of ordinary skill in the art would recognize how to tailor the controls and operation to achieve varying humidity and temperature goals. It is the provision of the various options into a refrigerant system that is inventive here.

It should be noted that in all the abovementioned scenarios the three-way valves can be either fixed or regulating flow control devices or can be substituted by a pair of conventional valves with similar capabilities. Also, an identical concept can be applied to a multi-circuit system, substantially improving its flexibility of matching the heat load requirements.

Since all the regimes discussed above can be executed in the conventional, economized and unloaded modes, various distinct stages of sensible and latent capacities are available for each mode of operation. Therefore, the selective operation of an appropriate reheat schematic in conjunction with the economizer cycle, enhances system ability in satisfying a wide spectrum of the latent and sensible capacity demands as well as augments temperature and humidity management. Additionally, system efficiency and operational flexibility are improved. Finally, the number of start-stop cycles is reduced, boosting system reliability.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. The refrigerant system comprising:

a compressor for compressing refrigerant and delivering refrigerant to a condenser, said refrigerant being delivered from said condenser to a main expansion device, and said refrigerant being delivered from said main expansion device to an evaporator, and an air moving device for moving air over said evaporator and into an environment to be conditioned, and refrigerant from said evaporator returning to said compressor;

a reheat coil for receiving a refrigerant, said reheat coil being positioned in a path of air moved by said air moving device, and refrigerant taps for passing refrigerant to said reheat coil, said refrigerant taps each being provided with a flow control device with one of said flow control devices located at a first location between said condenser and said compressor, and a second of said flow control devices located between said condenser and said main expansion device; and an economizer circuit for providing an economizer function.

2. The refrigerant system as set forth in claim 1, wherein said economizer circuit includes a refrigerant tapped from a main refrigerant line downstream of said condenser and upstream of said main expansion device, said tapped refrigerant passing through an economizer expansion device and into an economizer heat exchanger, said tapped refrigerant exchanging heat with a main refrigerant flow in said economizer heat exchanger.

3. The refrigerant system as set forth in claim 2, wherein said economizer circuit is positioned in a parallel arrangement with said reheat coil.

4. The refrigerant system as set forth in claim 2, wherein said economizer circuit is positioned in a sequential arrangement with said reheat coil.

5. The refrigerant system as set forth in claim 2, wherein said tap for said economizer circuit is located downstream of said second flow control device for said reheat coil.

6. The refrigerant system as set forth in claim 2, wherein a bypass flow control device is positioned to selectively bypass at least a portion of refrigerant around said condenser, said bypass flow control device being able to allow said portion of refrigerant to move from said compressor to a return point upstream of said main expansion device without passing through said condenser.

7. The refrigerant system as set forth in claim 6, wherein said tap for said economizer circuit is located downstream of said condenser and upstream of said return point.

8. The refrigerant system as set forth in claim 1, wherein an unloader device is positioned to selectively move refrigerant from compression chambers in said compressor back to a suction line leading to said compressor.

9. The refrigerant system as set forth in claim 1, wherein a line is positioned to communicate a refrigerant downstream of said reheat coil back to a location intermediate said condenser and said compressor, and a flow control device being positioned on said return line.

10. The refrigerant system as set forth in claim 3, wherein the reheat coil has an alternative downstream destination located intermediate said economizer heat exchanger and said main expansion device, and a flow control device placed upon a second return line leading to said alternative downstream destination.

11. The refrigerant system as set forth in claim 2, wherein said second flow control device for said reheat coil, which is downstream of said condenser, being positioned downstream of a location wherein main flow through said economizer heat exchanger returns to said main refrigerant line.

12. The refrigerant system as set forth in claim 1, wherein said second flow control device is positioned upstream of a return point for returning refrigerant from said economizer heat exchanger to a main refrigerant line.

13. A method of controlling a refrigerant system comprising the steps of:

(1) providing a compressor for compressing refrigerant, a condenser downstream of said compressor, a main expansion device downstream of said condenser, an evaporator downstream of said main expansion device, an air moving device for moving air over said evaporator and into an environment to be conditioned, a reheat coil for receiving a refrigerant, said reheat coil being positioned in a path of air moved by said air moving device, and refrigerant taps for passing refrigerant to said reheat coil, said refrigerant taps each being provided with a flow control device, with one of said flow control devices located at a first location between said condenser and said compressor, and a second of said flow control devices located between said condenser and said main expansion device, and an economizer circuit providing an economizer function; and (2) determining that a reheat function is utilized, and selecting one of said flow control devices to provide a refrigerant to said reheat coil.

14. The method as set forth in claim 13, wherein said economizer circuit is provided with a main refrigerant line and said economizer tap, with both said main refrigerant line and said economizer tap passing through an economizer heat exchanger, and an economizer expansion device provided on said economizer tap, and selectively passing refrigerant from said economizer tap through said economizer heat exchanger and through said economizer expansion device.

15. The method as set forth in claim 13, wherein a bypass line selectively allows refrigerant to bypass said condenser, said bypass line including a selectively open flow control device that controls the flow of refrigerant through said bypass line and around said condenser, and opening said flow control device when it is determined that it is desirable for said refrigerant to bypass said condenser.

16. The method as set forth in claim 13, wherein an unloader selectively communicates compressed refrigerant at said compressor back to a suction line for said compressor, and selectively opening said unloader to return refrigerant that has been compressed by said compressor to said suction line when desired.

* * * * *